US007353806B2

(12) United States Patent
Gant

(10) Patent No.: US 7,353,806 B2
(45) Date of Patent: Apr. 8, 2008

(54) FUEL INJECTOR WITH PRESSURE BALANCING VALVE

(75) Inventor: Gary L. Gant, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 11/516,044

(22) Filed: Sep. 6, 2006

(65) Prior Publication Data

US 2008/0053410 A1 Mar. 6, 2008

(51) Int. Cl.
*F02M 37/04* (2006.01)
*F02M 37/08* (2006.01)

(52) U.S. Cl. ..... 123/498; 123/506; 239/102.2

(58) Field of Classification Search ..... 123/498, 123/496, 506, 490; 239/102.2, 585.1, 585.2, 239/585.4

See application file for complete search history.

(56) References Cited

U.S. PATENT DOCUMENTS

| | | | | |
|---|---|---|---|---|
| 4,798,186 | A | 1/1989 | Ganser | |
| 5,873,526 | A | 2/1999 | Cooke | |
| 5,884,611 | A | 3/1999 | Tarr et al. | |
| 5,884,848 | A | 3/1999 | Crofts et al. | |
| 5,979,803 | A | 11/1999 | Peters et al. | |
| 6,253,736 | B1 | 7/2001 | Crofts et al. | |
| 6,313,568 | B1 | 11/2001 | Sullivan et al. | |
| 6,685,105 | B1 * | 2/2004 | Ruehle et al. | 239/102.1 |
| 6,948,667 | B2 | 9/2005 | Eichendorf | |
| 6,978,770 | B2 | 12/2005 | Rauznitz et al. | |
| 7,073,730 | B2 * | 7/2006 | Haag et al. | 239/102.2 |
| 2001/0032895 | A1 * | 10/2001 | Meyer | 239/585.1 |
| 2004/0074999 | A1 * | 4/2004 | Haag et al. | 239/585.1 |
| 2004/0124277 | A1 * | 7/2004 | Yoshimura et al. | 239/533.2 |

* cited by examiner

*Primary Examiner*—Mahmoud Gimie
(74) *Attorney, Agent, or Firm*—Nixon Peabody LLP; Tim L. Brackett, Jr.; J. Bruce Schelkopf

(57) ABSTRACT

A fuel injector device, for injecting fuel into a combustion chamber of an internal combustion engine, has a nozzle valve and nozzle valve control assembly adapted to use a control valve and high pressure fuel in the fuel injector in order to actuate movement of the nozzle valve between an open position to inject fuel and a closed position to terminate fuel injection. The nozzle valve control assembly employs a pressure balancing control valve so that the fuel pressure exerts a zero net force on the control valve in a dimension along which the control valve moves. Thus, the actuation occurs independently of the fuel pressure. In addition, the actuator is operably connected to the control valve by at least a hydraulic linkage, where the hydraulic linkage compensates for changes in the actuator and the injector body due to changes in temperature.

15 Claims, 3 Drawing Sheets

FUEL INJECTOR WITH PRESSURE BALANCING VALVE

BACKGROUND OF THE INVENTION

1. Field of the Invention

The present invention is directed to fuel injection systems, and more particularly to piezoelectric injection systems that function independently of injector pressure and operating temperature.

2. Description of Related Art

In most fuel supply systems applicable to internal combustion engines, fuel injectors are used to inject fuel pulses into the engine combustion chamber. A commonly used injector is a closed-nozzle injector which includes a nozzle assembly having a spring-biased nozzle valve element positioned adjacent the nozzle orifice for allowing fuel to be injected into the cylinder. The nozzle valve element also functions to provide a deliberate, abrupt end to fuel injection, thereby preventing a secondary injection which causes unburned hydrocarbons in the exhaust. The nozzle valve is positioned in a nozzle cavity and biased by a nozzle spring so that when an actuated force exceeds the biasing force of the nozzle spring, the nozzle valve element moves to allow fuel to pass through the nozzle orifices, thus marking the beginning of the injection event.

Internal combustion engine designers have increasingly come to realize that substantially improved fuel supply systems are required in order to meet the ever increasing governmental and regulatory requirements of emissions abatement and increased fuel economy. As such, one aspect of fuel supply systems that has been the focus of designers is the use of piezoelectric actuators in fuel injectors.

In general, piezoelectric actuators have long been recognized as highly desirable for use in systems requiring extremely fast mechanical operation in response to an electrical control signal. For this reason, piezoelectric actuators have received considerable attention by designers of fuel supply systems for internal combustion engines. Such designers are continually searching for ways to obtain faster, more precise, reliable, and predictable control over the timing and quantity of successive fuel injections into the combustion chambers of internal combustion engines to help meet the economically and governmentally mandated demands for increasing fuel economy and reduced air pollution. If such goals are to be attained, fuel control valves must be designed to provide extremely fast and reliable response times.

As discussed hereinbelow, conventional fuel injectors with piezoelectric actuators, however, suffer from notable disadvantages. For instance, the inherent design limitations of conventional piezoelectric fuel injectors make it more difficult to achieve certain performance characteristics, such as increased injection pressures. Moreover, the performance of conventional piezoelectric actuators is affected by environmental and operational factors, such as temperature.

Piezoelectric devices are capable of extremely fast and reliable valve response times. As a result, they offer greater control over fuel delivery, because they can be used to inject required amounts of fuel in a short time frame. The time frame for injecting fuel can be shortened by injecting the fuel at higher injection pressures. For instance, manufacturers have implemented extra high pressure injection systems, also known as XPI, where the pressures can reach 2400 bar. Such high injection pressures create smaller fuel droplets and higher injection velocity to promote more complete burning of the fuel, which maximizes power and increases fuel economy. In addition, pollution is minimized because the high thermal efficiencies result in low emissions of hydrocarbons (HC) and carbon monoxide (CO). By injecting required amounts of fuel in a shorter time frame, a high pressure system can accommodate multiple injection events during each combustion cycle. As a result, the engine control software can optimize combustion for particular conditions.

The use of very high injection pressures, however, requires piezoelectric actuators of conventional fuel injectors to operate with correspondingly high force levels. In general, piezoelectric actuators must act against the high pressure fuel in the fuel injector to move the nozzle valve into an open position causing the injection of fuel. For instance, in one type of fuel injector design, a control chamber filled with high pressure fuel is employed to bias the nozzle valve in the closed position against the force of a spring, and the piezoelectric actuator opens a control valve to expose the control chamber to a low pressure drain. When the fuel drains from the control chamber, the pressure in the control chamber drops and is no longer able to keep the nozzle valve in the closed position. In order to open the control valve, the piezoelectric actuator must act against the high pressure in the control chamber. Thus, piezoelectric actuators in such fuel injectors must provide large forces due to the high pressure which exists in the fuel injector.

Accordingly, the design of conventional piezoelectric actuators is dependent on the injector pressures. High pressure injection fuel injectors are required to use larger piezoelectric actuators to supply the necessary forces. Moreover, more power is required to operate conventional piezoelectric actuators with high injection pressures.

As mentioned previously, the performance of conventional piezoelectric actuators is also affected by environmental and operational factors, such as temperature. When used as a valve actuator, piezoelectric devices are known to provide extremely fast, reliable characteristics when calibrated to and operated at a relatively constant temperature. However, internal combustion engines are required to operate reliably over an extremely broad ambient temperature range. Moreover, fuel injection valves mounted directly on the engine are subjected to an even broader range of temperatures since the operating temperatures of an internal combustion engine may extend well above ambient temperatures and may reach 140° C. or more. Such temperature extremes can produce wide variations in the operating characteristics (e.g. length of stroke and/or reaction time) of a piezoelectric actuator. Conventional piezoelectric injectors have always experienced shifts in fueling due to temperature and the difference in the thermal expansion between the piezo ceramic and the material used to mount the piezo. In particular, the ceramic thermal coefficient of expansion is much lower than that for steel. Because the useable stroke of a piezoelectric actuator is in the 30 to 40 micron range, the thermal effects can exceed the stroke. Such actuator variations can lead to wide variations in timing and quantity of injected fuel when the piezoelectric actuator is used to control fuel injection into an internal combustion engine. Thus, conventional piezoelectric fuel injectors are affected by typical temperature variations in an engine.

SUMMARY OF THE INVENTION

In view of the foregoing, the present invention provides a fuel injection system to aid in reducing exhaust emissions and improving fuel economy, especially in engines not using exhaust gas recirculation.

In particular, advanced high pressure injection studies have shown the potential to meet extremely stringent emissions standards without exhaust after treatment, by increasing injection pressures from the current levels of about 2400 bar up to about 4000 bar. As noted previously, however, there are disadvantages to conventional piezoelectric fuel injectors, especially when operating with such high pressures.

Accordingly, the present invention is directed to a fuel injector with a actuator, such as a piezoelectric actuator, whose operation is independent of injection pressure in order to permit the actuator to operate more effectively and efficiently with extremely high injection pressures. Furthermore, the present invention is directed to a fuel injector that overcomes thermal effects which negatively impact the dimensional characteristics and performance of conventional piezoelectric fuel injectors.

Because the actuator operates independently of injection pressure, it does not have to supply such high forces. In particular, for a fuel injector using a piezoelectric actuator, a smaller, less expensive, high volume piezo stack can be used. For instance, where a 8000 N piezo stack is required by a conventional piezoelectric fuel injector, a 500 N stack is adequate for the present invention employing the same high pressure. Thus, the fuel injector according to the present invention can use a piezoelectric actuator that is smaller than conventional piezoelectric actuators. Also, the power required for the smaller piezoelectric actuator in the present invention is less than the power needed to operate the convention devices. Moreover, with a smaller piezoelectric actuator, the present invention can be more compact for better packaging in the engine.

An exemplary embodiment of the present invention employs a pressure balanced control valve. Because the valve is pressure balanced, there is no need for greater piezo forces with the use of greater injection pressures, as conventionally required. The embodiment also employs a hydraulic linkage, or column, to connect the piezoelectric actuator and the control valve. As a result, the length of the hydraulic linkage compensates for thermal growth and part tolerances, allowing the actuator performance to be independent of temperature. Accordingly, the piezoelectric actuator of this exemplary embodiment functions independently of injection pressure and temperature variation and provides a cost effective way to control fuel injection, which improves fuel economy and reduces exhaust emissions.

In particular, one illustrative embodiment of the present invention is a fuel injector device for injecting fuel into a combustion chamber of an internal combustion engine, where the fuel injector has an elongated injector body with an injector cavity, an injector orifice communicating with one end of the injector cavity, and a fuel supply circuit adapted to supply fuel for injection through the injector orifice. A nozzle valve element is positioned in the injector cavity where it moves between an open nozzle position, in which fuel flows from the fuel supply circuit through the injector orifice into the combustion chamber, and a closed nozzle position, in which fuel flow through the injector orifice is blocked. A control chamber receives fuel from the fuel supply circuit and holds fuel at a control chamber pressure, where the control chamber is positioned to cause movement of the nozzle valve element between the open nozzle position and the closed nozzle position according to the control chamber pressure. A low pressure drain is provided with a drain pressure lower than the control chamber pressure. A control valve closably connects the control chamber to the low pressure drain to change the control chamber pressure. The control valve includes a valve chamber with a first end, a second end, and a fuel entrance positioned between the first and second ends for receiving fuel from the control chamber, where the first end is a closable opening leading to the low pressure drain. The control valve also has a valve seat positioned at the first end of the valve chamber. Further, the control valve further includes a valve plunger movable along a first axis within the valve chamber between a closed plunger position, where the valve plunger is engaged with the valve seat to close the first end and block connection between the valve chamber and the low pressure drain, and an open plunger position, where the plunger is disengaged from the valve seat to open the first end and allow connection between the valve chamber and the low pressure drain. In addition, the control valve has an annular chamber within the valve chamber created by an annular indentation formed on the valve plunger with a first annular surface and a second annular surface opposing the first annular surface, where the fuel entrance is positioned between the first and second annular surfaces, and the first and second annular surfaces have equal areas so that pressure acting on the plunger along the first axis from fuel entering through the fuel entrance is balanced. A passageway leads from the control chamber to the fuel entrance of the valve chamber, where the passageway intersects the valve chamber along a second axis transverse to the first axis of the valve chamber. A piezoeletric actuator adapted to move the valve plunger between the open valve position and the closed valve position. A hydraulic linkage operably connects, at least partially, the piezoelectric actuator with the second end of the valve plunger and compensates for dimensional changes between the piezoelectric actuator with the second end of the valve plunger, especially due to changes in temperature.

In a further embodiment, a hydraulic linkage has a cavity adapted to receive fuel from the low pressure drain which is operably connected to the hydraulic linkage, and a piezoelectric actuator is operably connected to the valve plunger through at least the hydraulic linkage and adapted to exert an actuating pressure on the fuel in the cavity to cause movement of the valve plunger. The embodiment may further comprise a check valve adapted to block flow between the cavity and the low pressure drain when the cavity receives the actuating pressure to move the plunger valve into the open plunger position. Also, the embodiment may further comprise an actuating element actuated by the piezoelectric actuator to cause movement of the valve plunger, wherein the hydraulic linkage between the piezoelectric actuator and the valve plunger has a length that adjusts according to changes in separation between the actuator and the valve plunger, especially caused by the temperature changes, thereby keeping the distance required for movement of the actuating element to initiate movement of the valve plunger substantially constant.

These and other aspects of the present invention will become more apparent from the following detailed description of the preferred embodiments of the present invention when viewed in conjunction with the accompanying drawings.

DETAILED DESCRIPTION

Figure 1:
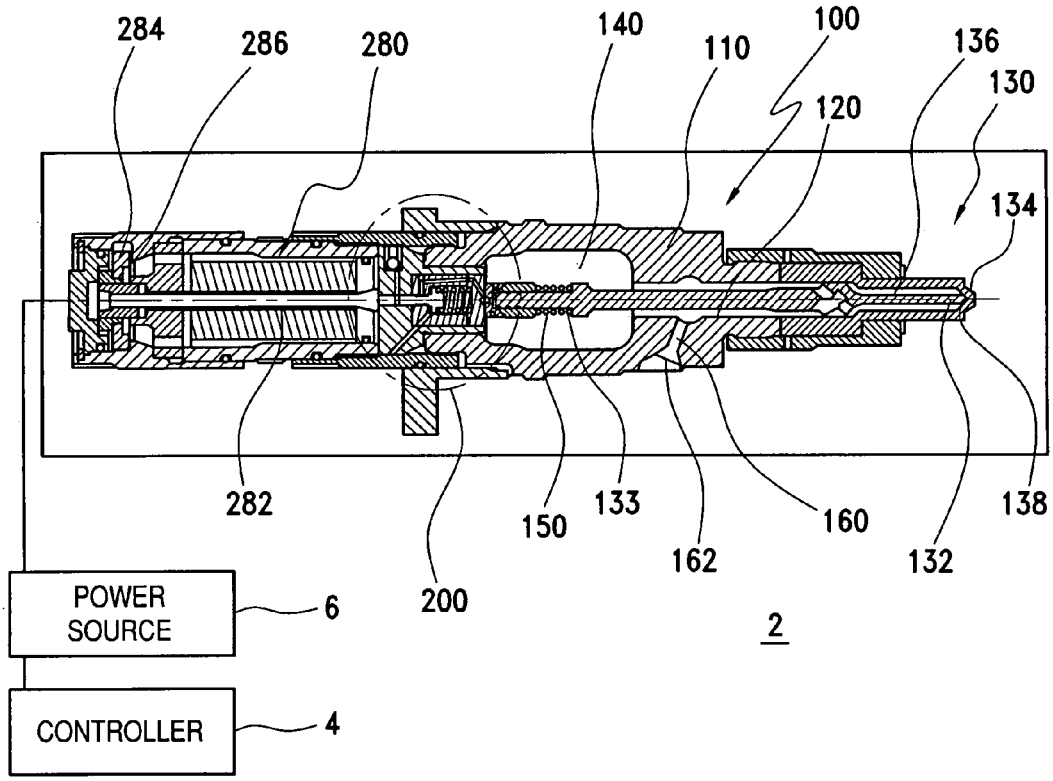
FIG. 1 is a schematic illustration of a piezoelectric fuel injection system, including is a cross-sectional view of a piezoelectric fuel injector, in accordance with one embodiment of the present invention.

FIG. 1 shows a schematic illustration of a piezoelectric fuel injection system 2 in accordance with one embodiment of the present invention that avoids the above noted limitations of conventional fuel injection systems. As described in further detail below, the piezoelectric fuel injection system 2 enables fuel injection in an internal combustion engine, such as a diesel engine, where actuation operates independently of injection pressure and operating temperature. Of course, the present invention may also be applied to other types of internal combustions as well.

The piezoelectric fuel injection system 2 of the illustrated embodiment includes a controller 4, such as an electronic control unit, that is connected to a power source 6, the controller 4 being adapted to control the power source 6. The power source 6 of the piezoelectric fuel injection system 2 is connected to a fuel injector 100 and provides power thereto, in the manner as further described below in accordance with the present invention. The fuel injector 100 receives fuel from a fuel source and is adapted to inject the received fuel into a combustion chamber of an internal combustion engine (not shown) during an injection event of a combustion cycle, details of the internal combustion engine and combustion cycles being known in the art and, thus, being omitted herein.

Figure 2:
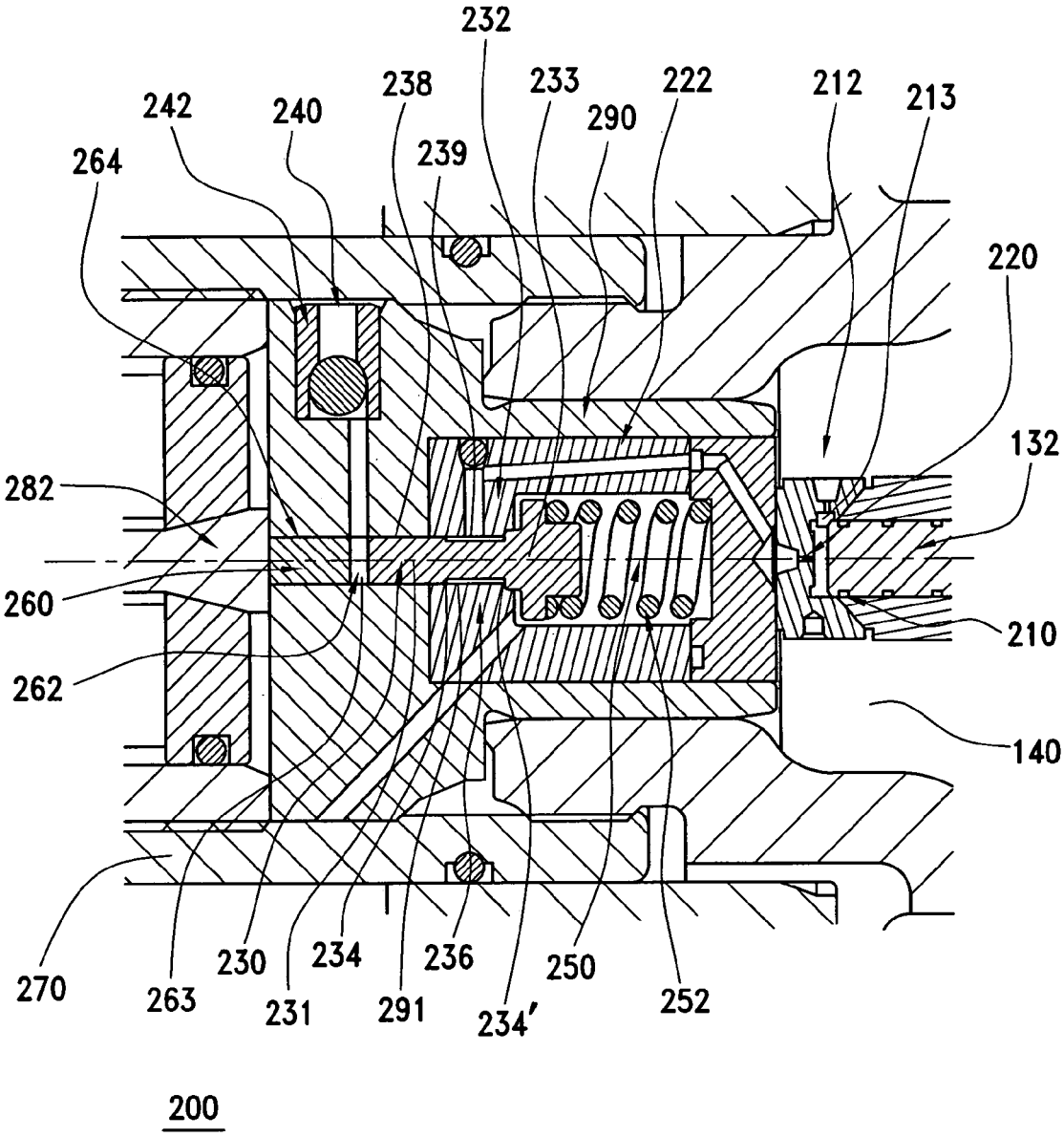
FIG. 2 is an enlarged cross-sectional view of a portion of the piezoelectric fuel injector of FIG. 1.
Figure 3:
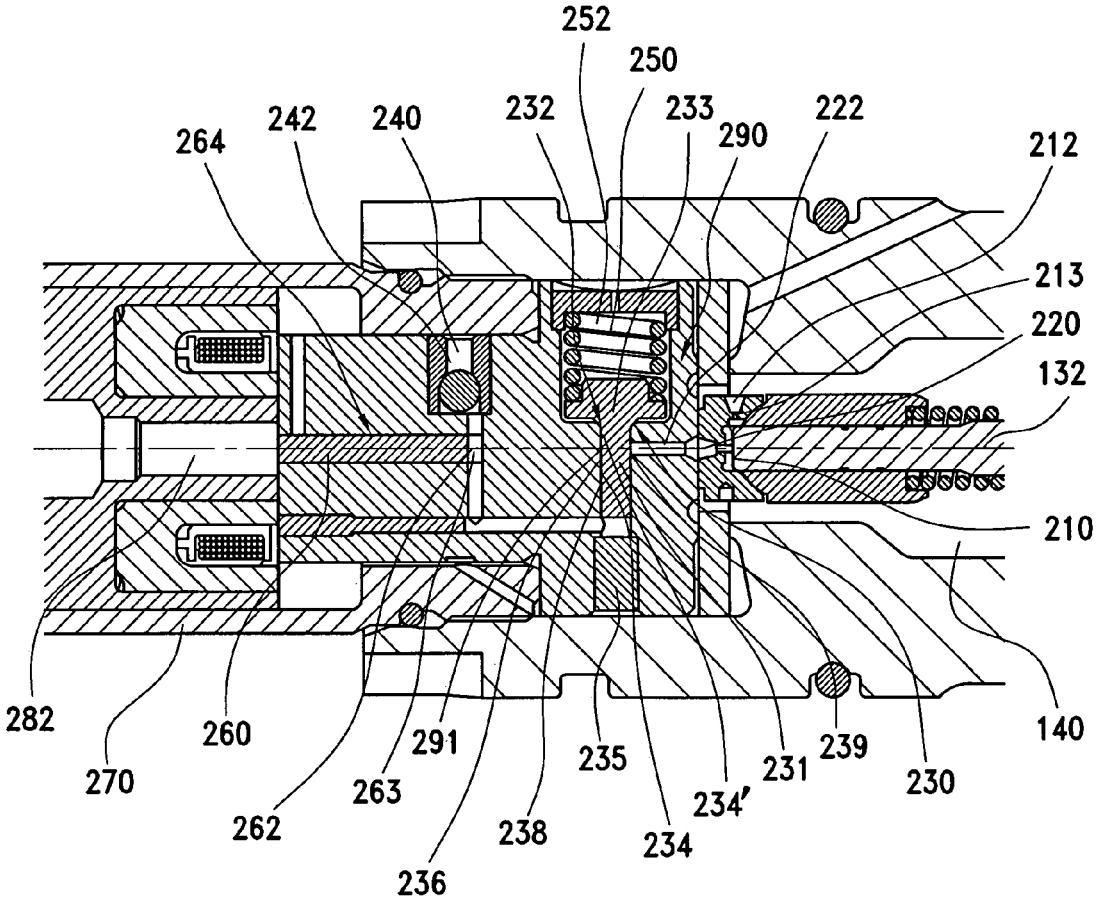
FIG. 3 illustrates an alternative arrangement for the elements shown in FIG. 2.

Referring to FIG. 1, a cross-sectional view of fuel injector 100 of the present invention is shown which is utilized in the implementation of the piezoelectric fuel injection system 2 in accordance with one example embodiment. As explained in detail below, the fuel injector 100 functions to effectively permit accurate and variable control of fuel metering. It should be initially noted that whereas specific details regarding the structure of the fuel injector 100 are shown in FIGS. 1-3 and discussed herein, fuel injector 100 is merely one example implementation thereof and other appropriately designed injectors may be utilized in the implementation of the present invention.

As can be appreciated by one of ordinary skill in the art by examination of FIG. 1, fuel injector 100 is a closed nozzle type fuel injector that is commonly utilized in high pressure common rail or pump-line-nozzle systems. However, the system and method of the present invention may be applied further to other types of fuel injection systems utilizing other types of injectors as well.

In the embodiment shown in FIG. 1, the fuel injector 100 is comprised of an injector body 110 having a generally elongated, cylindrical shape which forms an injector cavity 120. The lower portion of fuel injector body 110 includes a closed nozzle assembly 130, which includes a nozzle valve element 132 reciprocally mounted for opening and closing injector orifices 134, thereby controlling the flow of injected fuel into an engine combustion chamber.

Nozzle valve element 132 is preferably formed from an integral piece structure and positioned in a nozzle cavity 136 and a spring cavity 140. The spring cavity 140 contains a bias spring 150 for abutment against a land 133 formed on nozzle valve element 132 so as to bias the nozzle valve element 132 against a nozzle seat 138 into a closed position as shown in FIG. 1. A fuel transfer circuit 160 is provided in the injector body 110 for supplying high pressure fuel from an inlet 162 to nozzle cavity 136. For example, fuel injector 100 may be provided with high pressure fuel from a high pressure common rail or a pump-line-nozzle system (not shown).

Fuel injector 100 further includes a nozzle valve control assembly indicated generally at 200 for controlling the movement of nozzle valve element 132 between open and closed positions. The initial opening of the nozzle valve element 132 defines the beginning of an injection event during which fuel flows through injector orifices 134 into the combustion chamber of the internal combustion engine. Specifically, nozzle valve control assembly 200 operates to initiate, and control, the movement of nozzle valve element 132 including the degree of opening and the rate of opening of nozzle valve element 132. In addition, nozzle valve control assembly 200 operates to maintain nozzle valve element 132 in the open position for a specified duration so as to control the quantity of fuel injected. The degree of opening, the rate of opening, and the duration of opening for nozzle valve element 132 are controlled based on the operating conditions of the engine, for example, engine speed, load, throttle position, etc.

When operated in accordance with the present invention, nozzle valve control assembly 200 controls nozzle valve element 132 to control the rate shape of the fuel injection. This allows time varying change in the flow rate of fuel injected into the combustion chamber during an injection event. Correspondingly, such control of the rate shape allows improved fuel economy while reducing emissions.

As most clearly shown in the enlarged view of FIG. 2, nozzle valve control assembly 200 in the illustrated embodiment of fuel injector 100 includes a control chamber 210 positioned between a control chamber orifice 220 and the end of nozzle valve element 132 opposite the injector orifices 134. A control chamber charge circuit 212 is provided with a charge circuit orifice 213 for directing pressurized fuel into control chamber 210. The use of only two orifices, i.e. the charge circuit orifice 213 and the control chamber orifice 220, to direct fuel into and out of the control chamber 210 provides a simple configuration, which reduces variation and manufacturing complexity. The pressure in the control chamber 210 dictates the movement of the nozzle valve element 132 between an open position for fuel injection and a closed position for terminating fuel injection. The pressure is varied in the control chamber 210 by controlling the flow of high pressure fuel from the control chamber 210 to a low pressure drain circuit 240 using a pressure-balanced control valve 230. The control valve 230 is movable between a closed position for blocking fuel flow from the control chamber 210 to the drain circuit 240 and an open position permitting drain flow from control chamber 210. In particular, the control valve 230 includes a valve plunger 231 with a plunger end 233 adapted to seal the end of a closable valve chamber 238. In the embodiment of FIG. 2, the control valve plunger 231 reciprocates along the longitudinal axis of the fuel injector body 110. The valve plunger 231 is in the open position when the plunger end 233 is unseated from a valve seat 232 and is moved away from the end of the valve chamber 238.

As shown in FIGS. 1 and 2, the valve plunger 231 is actuated by a piezoelectric element 280 of nozzle valve control assembly 200 to allow selective movement of the valve plunger 231 so as to control the amount of fuel in control chamber 210, which in turn, controls the movement of nozzle valve element 132. In this regard, piezoelectric element 280 is operatively connected to an end of the valve plunger 231 via a center rod, or actuating element, 282, a drive plunger 260, and a fuel linkage 263 in cavity 262.

In the illustrated embodiment, piezoelectric element 280 comprises a columnar laminated body of thin disk-shaped elements, each having a piezoelectric effect so that when a voltage is applied to the piezoelectric element 280, the elements become charged and expand along the axial direction of the column. The preload of piezoelectric element 280 is adjustable via disc springs 284 and adjustment nut 286. Of course, piezoelectric element 280 may be of any type or design in other embodiments that is suitable for actuating the valve plunger 231. The embodiments described herein are described with respect to a piezoelectric actuator, which provide extremely fast and reliable valve response times and are capable of more injections per cycle than other known mechanisms. However, it is apparent that devices according to the present invention may employ other electro-mechanical actuators. The amount of expansion of piezoelectric element 280 corresponds to the specific design of the elements, the voltage being controlled, for example, by controller 4, and the amount of voltage applied to the piezoelectric element. In addition, the duration and amount of voltage provided by controller 4 determines the amount of fuel injected by fuel injector 100. The voltage duration and amount or level at various stages of the injection event are controlled or varied based on the operating conditions of the engine such as engine speed, engine load, throttle position, etc. At the end of an injection event, when the voltage is turned off, i.e. zero volts are provided, the piezoelectric element 280 is discharged so that it reverts back to its original position thereby causing valve plunger 231 to move into the closed position which causes nozzle valve element 132 to move into its closed position.

Referring again to FIG. 1, and as previously noted, the actuation and de-actuation (i.e. charging and discharging) of piezoelectric element 280 of nozzle valve control assembly 200 is controlled by controller 4. The controller 4 is preferably implemented as an electronic control unit that is adapted to precisely control the operation of the piezoelectric element 280 to thereby control the timing of injection as well as the amount of fuel that is injected during the injection event. Moreover, the controller 4 in accordance with the present invention, is further adapted to control the injection rate shape so that emissions can be reduced and fuel economy enhanced.

During operation, the start and end of injection are controlled according to pressure in the control chamber 210. Prior to an injection event, the piezoelectric element 280 is de-energized causing valve plunger 231 to be biased into the closed position with the valve plunger 231 in sealing engagement against the valve seat 232 by seating spring 252. It is noted, in particular, that the seating spring 252 eliminates any need to use high pressure fuel to bias the valve plunger 231 in the closed position. In this no-fuel state, the control chamber 210 receives fuel at injection pressure through the control chamber charge circuit 212. Specifically, the fuel pressure level experienced in the injector cavity 120 surrounding the nozzle valve element 132 is also present in the control chamber 210 since drain flow from the control chamber 210 to the drain circuit 240 is blocked by valve plunger 231. As a result, the fuel pressure in the control chamber 210 acting on nozzle valve element 132, in combination with the bias force of bias spring 150, maintains nozzle valve element 132 in its closed position blocking flow through injector orifices 134. The pressure in control chamber 210 provides a high seat load to minimize any leakage.

At a predetermined time, controller 4 controls power source 6 so as to charge or energize piezoelectric element 280 with voltage to controllably cause the expansion of piezoelectric element 280 and movement of center rod 282 against the drive plunger 260. The resulting movement of the drive plunger 260 increases the pressure in cavity 262, which is filled with fuel acting as a fuel, or hydraulic, linkage 263. The fuel linkage 263 in cavity 262 applies a force sufficient to overcome the force of seating spring 252 and moves the valve plunger 231 to an open position. The pressure in cavity 262 must be sufficient to overcome the biasing force of the sealing spring 252, as the sealing spring 252 provides sufficient force to seal the valve plunger 231 against the valve seat 232.

The movement of valve plunger 231 is thus controlled by controlling the voltage applied to piezoelectric element 280. Thus, the distance between the valve plunger 231 and the valve seat 232 is controlled to vary the drain flow from control chamber 210 which ultimately permits precise control over the movement of nozzle valve element 132 between its closed and open positions.

As the valve plunger 231 of the control valve 230 is lifted from the valve seat 232, fuel flows from control chamber 210 through drain circuit 240 to a low pressure drain. Simultaneously, high pressure fuel flows from control chamber charge circuit 212 and the associated orifice 213 into control chamber 210. However, since the control chamber charge circuit orifice 213 is designed with a smaller cross-sectional flow area than the drain or control valve orifice 220, a greater amount of fuel is drained from control chamber 210 than is replenished via control chamber charge circuit 212. The pressure in control chamber 210 immediately decreases. As a result of the decreasing control chamber pressure, fuel pressure forces acting on nozzle valve of element 132 due to high pressure fuel in injector cavity 120, begin to move nozzle valve element 132 against the bias force of spring 150 into an open position.

When the valve plunger 231 moves into the open position, the control chamber 210 is connected to the drain circuit 240 by a drainage assembly 290, which includes an orifice 220, a drilling or passageway 222, the valve chamber 238, and the spring cavity 250. Due to the pressure difference, fuel in the control chamber 210 travels through the drainage assembly 290 and is vented to the drilling 240 and to drain. In particular, the orifice 220 is positioned at one end of the control chamber 210, opposite the end of the injector plunger 132. The higher pressure fuel in control chamber 210 exits the control chamber 210 into the drilling 222. Because the spring cavity 250 in the embodiment of FIG. 2 is positioned between the control chamber 210 and the valve chamber 238, the drainage assembly 290 creates a fuel passage that extends away from the control chamber 210 and past the spring cavity 250, but proceeds back toward the control chamber 210 into the spring cavity 250. In particular, the drilling 222 in FIG. 2 extends away from the orifice 220 and along a path substantially parallel to the longitudinal axis of the fuel injector body 110, past the spring cavity 250 and the valve seat 232. The drilling 222 then proceeds transversely to the valve chamber 238. The valve chamber 238 in the embodiment of FIG. 2 is an elongate chamber that is oriented substantially parallel to the longitudinal axis of the fuel injector body 110. As a result, the fuel from the drilling 222 is introduced transversely into the valve chamber 238 at a fuel entrance 239. With the valve plunger 231 in the open position, a passage extends longitudinally from the fuel entrance 239, along the valve plunger 231 and past the valve seat 232, to the spring cavity 250. The elongate spring cavity in the embodiment of FIG. 2 is also oriented substantially parallel to the longitudinal axis of the fuel injector body 210. The drilling 240 leads from the spring cavity 250 to drain.

Thus, with the valve plunger 231 in the open position, the fuel is vented from the control chamber 210, through the orifice 220 and the drilling 222, into the valve chamber 238, past the valve plunger 231 and the valve seat 232, and through spring cavity 250 and drilling 240 to drain. The resulting drop in pressure in control chamber 210 at one end of the injector plunger 132 allows the injector plunger 132 to lift away from the valve seat 138 allowing fuel flow into the engine combustion chamber.

As further shown in FIG. 2, the valve plunger 231 is exposed to the high pressure of fuel entering through the fuel entrance 239 from the drilling 222. However, the pressure does not create a net force on the valve plunger 231, which would have the effect of biasing the valve plunger 231 into either the open or closed position. In particular, fuel entering through the fuel entrance 239 passes through an annular chamber, or cavity, 236 between the valve plunger 231 and the walls of the valve chamber 238. The annular chamber 236 is formed in part by an annular indentation 291 in the valve plunger 231. The annular chamber 236 extends longitudinally to one end of the valve chamber 238 at the valve seat 232, where the fuel can flow into the spring cavity 250 when the valve plunger 231 is unseated from the valve seat 232. Fuel flowing from the control chamber 210 enters a middle section of the annular chamber 236 and exerts a pressure on opposing, or facing, sides 234 and 234' of the annular indentation 291 extending substantially transverse to the movement of the valve plunger 231. The opposing sides 234 and 234' have equal areas. As illustrated in FIG. 2, the first opposing surface 234 on valve plunger 231 has the same area as the second opposing surface 234' on the valve plunger 231 adjacent to the valve seat 232. The pressure on the valve plunger 231 exerted by the fuel from the control chamber 210 is balanced along the dimension, or path, in which the valve plunger 231 moves, because the pressure acts on two opposing, or facing, surfaces 234 and 234' of the valve plunger 231 having equal area. Accordingly, the force necessary to move the valve plunger 231 between the open and closed positions is independent of the injection pressure, and the force from the piezoelectric element 280 transmitted to the valve plunger 231 does not have to overcome the injection pressure as with conventional piezoelectric fuel injectors.

When injection is ended, the piezoelectric element 280 is de-energized. The piezoelectric center rod 282 retracts and moves away from the drive plunger 211, causing the pressure in cavity 262 to drop and reducing the amount of force acting against the biasing force of the spring 252. Thus, the biasing force of spring 252 is able to push the drive plunger 211 toward the piezoelectric element 280 and move the valve plunger 231 into the closed position, with the plunger end 233 seated at the valve seat 232. As a result, the control chamber 210 is filled with high pressure fuel through charge circuit orifice 213. The high pressure in the control chamber 210 forces the injector plunger 132 to be seated against nozzle seat 138, and ends the fuel injection.

While the piezoelectric actuator 280 is de-energized, cavity 262 is filled, and maintained, with fuel from the drain 240 flowing through a check valve 242, which opens with the corresponding drop in the pressure of cavity 262. The drain pressure is maintained at a sufficient level to assure filling of the cavity 262.

Advantageously, a controlled leakage of fuel from cavity 262 past drive plunger 260, through a channel 264, allows any air to be expelled to drain. This controlled leakage and the retraction of the piezoelectric element 280 result in an increase in the volume in cavity 262, which leads to a reduction of the pressure in the cavity 262 and assists seating of the plunger 230.

The flow of fuel from the drain 240 to fill the cavity 262 provides a source of filtered and cooler fuel to form the fuel linkage 263. The fuel in the fuel linkage 263 is not trapped. Thus, the fuel from the drain 240 provides a constant source of fuel to refill the cavity 262 and to make up for any fuel that leaks from the cavity 262. This cycling of fuel and the introduction of the cleaner fuel helps minimize the damaging effects of dirt and particles that would otherwise be trapped in the cavity 262. The cleaner fuel also helps to make the fluid properties more consistent. Moreover, the cycling of fuel provides a path for heat to be dissipated, and the introduction of cooler fuel reduces changes in temperature and corresponding changes in viscosity and other temperature-dependent properties.

When piezoelectric actuator 280 is energized and the cavity 262 is pressurized, the pressure causes the check valve 242 to be seated and close connection with the drain 240. Thus, the check valve 242 prevents fuel from exiting to the drain 240 when a higher pressure is required in the cavity 262 to move the valve plunger 231 into the open position.

The fuel linkage 263 in cavity 262 changes to compensate for any dimensional difference in length between the piezoelectric element 280 and the housing 270 due to temperature. In other words, the fuel linkage 263 connects the action of the piezoelectric element 280 to the valve plunger 231. Thus, the present invention compensates for thermal growth and part tolerances through the length, or height, of the fuel linkage 263, allowing the performance of the piezoelectric element 280 to be independent of temperature.

The increased pressure in the chamber 262 or the increased stroke of the valve plunger 231 can be achieved by the relative sizing of the drive plunger 260 to the valve plunger 231 for the same actuator stroke.

There may be leakage between the valve chamber 238 and hydraulic link cavity 262 past valve plunger 231, where the fuel in valve chamber 238 is under a higher pressure. However, the valve plunger 231 has an adequate length-to-diameter ratio, or sealing length, to minimize the amount of leakage. In addition, as discussed above, the hydraulic link pressure is maintained at a pressure when the injector is not fueling, and at a much higher pressure during injection. The higher pressure in cavity 262 during injection occurs due to force applied by the piezoelectric actuator 280 on drive plunger 260 with the check valve 242 sealing the hydraulic cavity from the drain circuit 240. Accordingly, although there may be a continuous leakage path between valve chamber 238 and hydraulic link cavity 262, the pressure in hydraulic link cavity 262 reduces the pressure difference between valve chamber 238 and hydraulic link cavity 262, thus minimizing the amount of leakage.

FIG. 3 illustrates an alternative arrangement of the elements presented in FIGS. 1 and 2. The elements of FIG. 3 referenced by like reference numerals refer to similar elements described above with respect to FIGS. 1 and 2. Elements similar to those in the design of nozzle valve control assembly in FIGS. 1 and 2, discussed previously, are located differently, for instance, to accommodate packaging constraints. As FIG. 3 illustrates, the present invention is not limited to the arrangement shown in FIGS. 1 and 2. Unlike the nozzle valve control assembly 200 in FIG. 2, the valve plunger 231, valve chamber 238, bias spring 252, and spring chamber 250, as shown in FIG. 3, are transversely oriented with respect to the longitudinal axis of injector body 110. The valve plunger 23.1 reciprocates in the valve chamber along an axis transverse, and more specifically perpendicular, to the longitudinal axis of the fuel injector body 110. Correspondingly, the bias spring 252 applies a biasing force against the valve plunger 231 along this transverse axis.

The valve plunger 231 is actuated by a piezoelectric element 280 of nozzle valve control assembly 200 to cause movement of the valve plunger 231 and the nozzle valve element 132 into their respective open positions. When the valve plunger 231 moves into the open position, the control chamber 210 is connected to the drain circuit 240 by a drainage assembly 290, which includes an orifice 220, a drilling 222, the valve chamber 238, and the spring cavity 250. The drilling 222 in the embodiment of FIG. 3, however, extends from the orifice 220 along the longitudinal axis of the fuel injector body 110, directly to the valve chamber 238. The fuel from the drilling 222 is nevertheless introduced transversely into the valve chamber 238. With the valve plunger 231 in the open position, a passage extends transversely from the drilling 222, along the valve plunger 231 and past the valve seat 232, to the spring cavity 250.

Moreover, unlike FIG. 2, the chamber 262 with fuel linkage 263 in FIG. 3 has a different shape that enables the fuel linkage 263 to exert pressure on the valve plunger 231. In other words, the fuel linkage 263 first extends transversely from the drive plunger 260 and then proceeds along a path parallel to the longitudinal axis of the fuel injector body 110 to one end of the valve plunger 231. With this particular arrangement, a closing plug 235 is required to close one side of fuel linkage 263 opposite the valve plunger 231. Accordingly, the plug 235 is positioned on one side of the longitudinal axis of the fuel injector body 110, while the bias spring 252 is positioned on the other side.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. A piezoelectric-actuated fuel injector device for injecting fuel into a combustion chamber of an internal combustion engine, the fuel injector device comprising:

an elongate injector body with an injector cavity, an injector orifice communicating with one end of the injector cavity, and a fuel supply circuit adapted to supply fuel for injection through the injector orifice;

a nozzle valve element in the injector cavity, the nozzle valve element adapted to move between an open nozzle position, in which fuel flows from the fuel supply circuit through the injector orifice into the combustion chamber, and a closed nozzle position, in which fuel flow through the injector orifice is blocked;

a control chamber adapted to receive fuel from the fuel supply circuit and hold fuel at a control chamber pressure, the control chamber positioned to cause movement of the nozzle valve element between the open nozzle position and the closed nozzle position according to the control chamber pressure;

a low pressure drain;

a control valve closably connecting the control chamber to the low pressure drain to change the control chamber pressure, the control valve comprising:

a valve chamber with a first end, a second end, and a fuel entrance positioned between the first and second ends for receiving fuel from the control chamber, the first end being a closable opening leading to the low pressure drain;

a valve seat positioned at the first end of the valve chamber;

a valve plunger movable along a first axis within the valve chamber between a closed plunger position, where the valve plunger is engaged with the valve seat to close the first end and block connection between the valve chamber and the low pressure drain, and an open plunger position, where the plunger is disengaged from the valve seat to open the first end and allow connection between the valve chamber and the low pressure drain; and an annular chamber within the valve chamber created by an annular indentation formed on the valve plunger, with a first annular surface and a second annular surface opposing the first annular surface, the fuel entrance being positioned between the first and second annular surfaces, and the first and second annular surfaces adapted to balance pressure acting on the plunger along the first axis from fuel entering through the fuel entrance;

a passageway leading from the control chamber to the fuel entrance of the valve chamber, the passageway intersecting the valve chamber along a second axis transverse to the first axis of the valve chamber;

a piezoelectric actuator adapted to move the valve plunger between the open valve position and the closed valve position; and a hydraulic linkage adapted to operably connect, at least partially, the piezoelectric actuator with the second end of the valve plunger and to compensate for dimensional changes between the piezoelectric actuator and the second end of the valve plunger.

2. The fuel injector device according to claim 1, further comprising a seating spring biasing the plunger against the valve seat.

3. The fuel injector device according to claim 2, further comprising a spring cavity within which the seating spring is positioned, the spring cavity further connecting the valve chamber and the low pressure drain.

4. The fuel injector device according to claim 1, wherein the first axis, along which the valve plunger is movable, is substantially parallel to a longitudinal axis of the fuel injector body.

5. The fuel injector device according to claim 4, further comprising:

a seating spring biasing the plunger against the valve seat; and a spring cavity holding the seating spring and positioned longitudinally between the control chamber and the valve chamber, the spring cavity further connecting the valve chamber and the low pressure drain, wherein the passageway extends from the control chamber longitudinally past the spring cavity and transversely to the valve chamber.

6. The fuel injector device according to claim 1, wherein the first axis, along which the valve plunger is movable, is substantially perpendicular to a longitudinal axis of the fuel injector body.

7. The fuel injector device according to claim 1, wherein the first annular surface and the second annular surface of the annular indentation on the valve plunger have equal areas when projected onto a plane transverse to the first axis.

8. The fuel injector device according to claim 1, wherein the annular chamber extends to the first end of the valve chamber.

9. The fuel injector device according to claim 1, wherein actuator moves a center rod against a drive plunger that in turn increases pressure in the hydraulic linkage, causing movement of the valve plunger.

10. The fuel injector device according to claim 1, further comprising an actuating element actuated by the piezoelectric actuator to cause movement of the valve plunger, wherein the hydraulic linkage between the piezoelectric actuator and the valve plunger has a length that adjusts according to changes in separation between the actuator and the valve plunger, thereby keeping the distance required for movement of the actuating element to initiate movement of the valve plunger substantially constant.

11. A piezoelectric-actuated fuel injector device for injecting fuel into a combustion chamber of an internal combustion engine, the fuel injector device comprising:

an elongate injector body with an injector cavity, an injector orifice communicating with one end of the injector cavity, and a fuel supply circuit adapted to supply fuel for injection through the injector orifice;

a nozzle valve element in the injector cavity, the nozzle valve element adapted to move between an open nozzle position, in which fuel flows from the fuel supply circuit through the injector orifice into the combustion chamber, and a closed nozzle position, in which fuel flow through the injector orifice is blocked;

a control chamber adapted to receive fuel from the fuel supply circuit and hold fuel at a control chamber pressure, the control chamber positioned to cause movement of the nozzle valve element between the open nozzle position and the closed nozzle position according to the control chamber pressure;

a low pressure drain;

a control valve closably connecting the control chamber to the low pressure drain to change the control chamber pressure, the control valve comprising:

a valve chamber with a first end, a second end, and a fuel entrance positioned between the first and second ends for receiving fuel from the control chamber, the first end being a closable opening leading to the low pressure drain;

a valve seat positioned at the first end of the valve chamber; and a valve plunger movable, within the valve chamber, along a chamber axis transverse to a longitudinal axis of the fuel injector body, between a closed plunger position, where the valve plunger is engaged with the valve seat to close the first end and block connection between the valve chamber and the low pressure drain, and an open plunger position, where the plunger is disengaged from the valve seat to open the first end and allow connection between the valve chamber and the low pressure drain;

a piezoelectric actuator adapted to exert an actuating pressure to cause movement of the valve plunger; and a cavity communicating with the low pressure drain, the cavity adapted to receive fuel from the low pressure drain to form a hydraulic linkage between the piezoelectric actuator and the valve plunger.

12. The fuel injector device according to claim 11, further comprising a check valve adapted to block flow between the cavity and the low pressure drain when the cavity receives the actuating pressure to move the plunger valve into the open plunger position.

13. The fuel injector device according to claim 11, wherein the cavity has a volume, the volume being adjustable to change the pressure in the cavity.

14. The fuel injector device according to claim 11, comprising a channel adapted to allow controlled leakage of fuel from the cavity.

15. The fuel injector device according to claim 11, further comprising an actuating element actuated by the piezoelectric actuator to cause movement of the valve plunger, wherein the cavity between the piezoelectric actuator and the valve plunger has a length that adjusts according to changes in separation between the actuator and the valve plunger, thereby keeping the distance required for movement of the actuating element to initiate movement of the valve plunger substantially constant.

* * * * *